US005195255A

United States Patent [19]

Coughlin

[11] Patent Number: 5,195,255

[45] Date of Patent: Mar. 23, 1993

[54] INSOLE RIB WELTING MATERIAL

[75] Inventor: Thomas E. Coughlin, Tynsgsboro, Mass.

[73] Assignee: Worthen Industries, Inc., Nashua, N.H.

[21] Appl. No.: 618,266

[22] Filed: Nov. 21, 1990

[51] Int. Cl.[5] ..... A43B 13/28

[52] U.S. Cl. ..... 36/12; 36/17 R; 36/22 R

[58] Field of Search ..... 36/12, 43, 17 R, 17 A, 36/17 PW, 22 A, 78; 12/146 B, 146 BC, 146 BP

[56] References Cited

U.S. PATENT DOCUMENTS

| | | | |
|---|---|---|---|
| 2,312,527 | 3/1943 | Cutler | 36/17 |
| 2,847,339 | 8/1958 | Strickland | 154/53.5 |
| 4,146,934 | 4/1979 | Cohen | 2/127 |
| 4,241,124 | 12/1980 | Kremer et al. | 428/156 |
| 4,642,912 | 2/1987 | Wildman et al. | 36/44 |

*Primary Examiner*—Paul T. Sewell
*Assistant Examiner*—Thomas P. Hilliard
*Attorney, Agent, or Firm*—Samuels, Gauthier & Stevens

[57] ABSTRACT

An insole rib wherein the fabric encapsulating the rib is formed of a twill weave such that the rib will lie flat when adhered to the contour of an insole without puckering or crimping.

1 Claim, 1 Drawing Sheet

INSOLE RIB WELTING MATERIAL

FIELD OF THE INVENTION

The present invention relates to the manufacture of welted footwear.

BACKGROUND AND BRIEF SUMMARY OF THE INVENTION

For many years, the traditional method for well made, waterproof walking shoes has been the machine welted method. The method utilizes an insole with an upstanding wall or insole rib which is positioned about 7/32" from the edge of the insole. During the lasting process, the upper and lining (if the shoe is fully lined) are secured to the insole rib. A strip of leather, vinyl, etc., known as the welt, is then sewn in to combine the welt, upper and lining to the insole rib. After the welt has been sewn in, the sole is stuck to the shoe bottom and is stitched through the welt by means of a lock-stitch machine.

A variety of insole ribs are available. Basically, each of these consists of a fiber core covered with a tape or fabric flanged out at each side to define the rib. The rib is either upright or angled. The attachment of the insole rib to the insole is virtually the same for all types. Originally, the insole rib was applied only to leather insoles but today the insole ribs are attached to a variety of insoles.

The insole rib is coated with adhesive, usually a neoprene, allowed to dry and then stored on a reel. The insole rib is fed from a reel and attached to the insole by a special rib-laying machine which uses a jet of hot air to heat-activate the adhesive immediately prior to the rib being attached by a hammering action. It is essential that the rib be accurately positioned in relation in the insole edge; normally 7/32" from the edge.

The prefabricated rib is essentially a woven textile comprised of either cotton, polyester or polyester cotton fibers, coated on one side with an elastomeric adhesive and formed around slit strips of unsaturated leatherboard or TEXON, a latex rubber saturated paper sheet, type paperboard. In attaching the insole rib to the insole, the rib must make two or three turns including a particularly sharp turn at the toe. The turns result in crimps, bumps or puckers—all of which are objectionable. Currently the insole ribs offered have pinked or cut edges to minimize the problem caused by these turns.

The present invention entails the use of a fabric for an insole rib where the warp and weft threads are arrayed such that when the insole rib is secured to the insole the weave contracts along its inner diameter and expands along its outer diameter while lying substantially in the same plane. Because of this, the insole rib can be made without pinking, although it can also be made with pinking if desired. This results in the insole rib lying substantially flat along its entire length when adhered to the insole.

DESCRIPTION OF THE PREFERRED EMBODIMENT(S)

The insole rib of the present invention may be used with any welted or other footwear where an insole rib is required.

Figure 1:
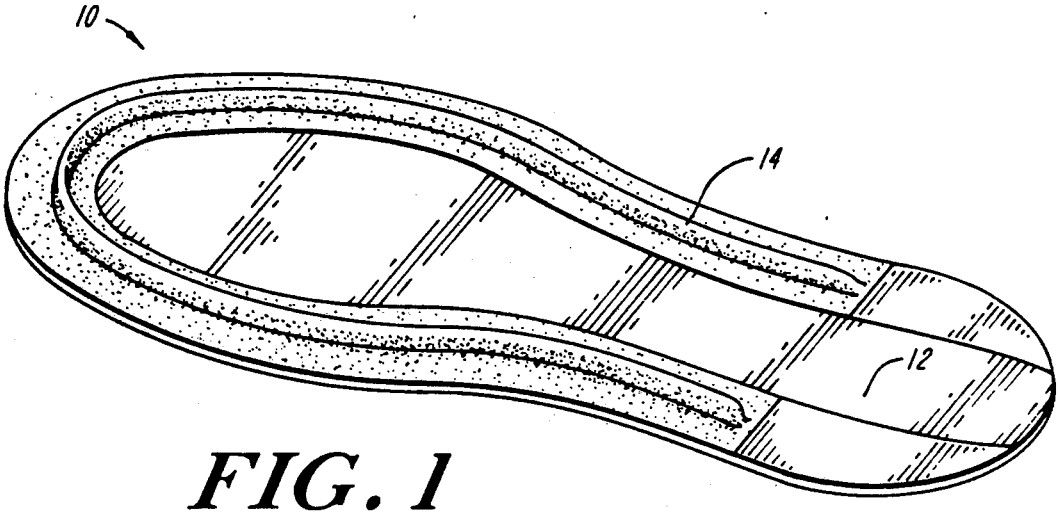
FIG. 1 is a bottom view showing an inner sole and an insole rib.

Referring to FIG. 1, a ribbed insole 10 is shown and comprises an insole 12 and an insole rib 14. The fabric formed around the rib 14 rib 14 must lie flat on the contour of the sole. It is adhered to the inside using conventional techniques.

Figure 2:
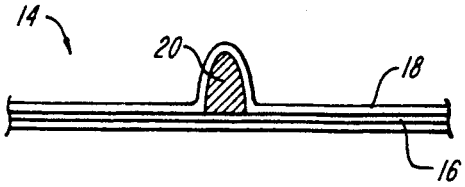
FIG. 2 is a side view of an insole rib embodying the invention.

The insole rib 14 is shown in greater detail in FIG. 2 and comprises a film of adhesive 16, such as a neoprene adhesive system commonly used in the industry, a fabric material 18, such as polycotton duck fabric, formed around a rib 20. The formation of the insole rib 14 is conventional except that the fabric material 18 used is distinct and the insole rib will follow the contour of the insole and lie flat without puckering.

A preferred weave for the fabric is a twill weave. These weaves are characterized by diagonal ribs (twill lines). If the ribs run from bottom left to top right it is called a right-hand twill, if they run from top left to bottom right it is called a left-hand twill. For equal density of warp and weft, the ribs run at an angle of 45°. If the warp density is greater than the weft density, the ribs run at a steeper angle (steep twill) and visa versa (reclining twill). The preferred fabric which provides the required expansion and compression action is a 1.24 twill, 66/33 poly cotton, 8.05 oz per square yard and 0.027 inch thickness. In using this fabric, the stretch comes from the fabric weave. Referring to the type of construction of the fabric, the preferred fabric is a 1-2 twill polycotton weave. This arrangement of the warp and weft threads allows for a 45° expansion and/or contraction when tension is applied.

Figure 3:
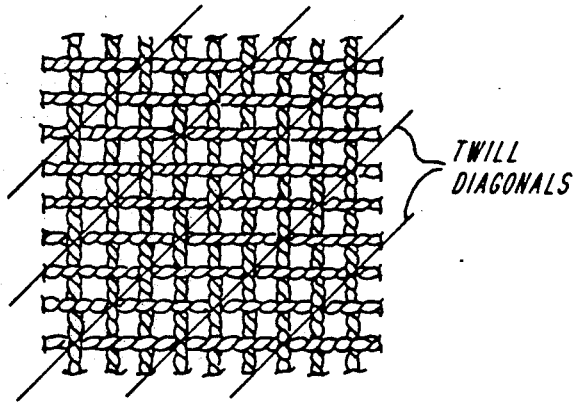
FIG. 3 illustrates an insole rib of the invention in unstretched conditions.

In FIG. 3, the fabric 18 is shown diagrammatically in its un-stretched condition. In its stretched condition, the threads at the inner edge are closely gathered and expand or fan out toward the outer edge to allow for the expansion.

Other twill weaves may be double-faced twill where the fabric presents the same appearance on both sides. Usually a distinction is made between simple and fancy twills. In the former, the same number of warped threads are placed successfully above or below each weft thread and the ribs are of uniform width. In the latter, more warp threads may be above one weft thread than the other and the ribs may vary in width.

The foregoing description has been limited to a specific embodiment of the invention. It will be apparent, however, that variations and modifications can be made to the invention with the attainment of some or all of the advantages of the invention. Therefore, it is the object of the appended claims to cover all such variations and modifications as come within the true spirit and scope of the invention.

Having described my invention, what I now claim is:

1. In an insole rib which comprises a rib and a fabric, the fabric enclosing and securing the rib to an insole, the fabric adhered to the insole and extending outwardly from the rib, the improvement which comprises:

the fabric comprising warp and weft threads arrayed to form a twill weave, the edges of the fabric non-pinked and adhered to the insole and lying flat on the insole and in parallel relationship, and wherein the fabric is a 1-2 twill polycotton weave.

* * * * *